US005308734A

United States Patent [19]

Sacripante et al.

[11] Patent Number: 5,308,734

[45] Date of Patent: May 3, 1994

[54] TONER PROCESSES

[75] Inventors: Guerino G. Sacripante, Oakville; Grazyna E. Kmiecik-Lawrynowicz, Burlington, both of Canada

[73] Assignee: Xerox Corporation, Stamford, Conn.

[21] Appl. No.: 989,613

[22] Filed: Dec. 14, 1992

[51] Int. Cl.[5] ..... G03G 9/08

[52] U.S. Cl. ..... 430/137; 523/335; 526/910

[58] Field of Search ..... 430/137; 523/335, 352; 526/910; 528/936

[56] References Cited

U.S. PATENT DOCUMENTS

| | | | |
|---|---|---|---|
| 2,995,512 | 8/1961 | Weidner et al. | 528/936 |
| 4,831,116 | 5/1989 | Henton | 528/936 |
| 5,212,036 | 5/1993 | Ciccarelli et al. | 430/137 |

*Primary Examiner*—Christopher Rodee
*Attorney, Agent, or Firm*—E. O. Palazzo

[57] ABSTRACT

A process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

29 Claims, No Drawings

TONER PROCESSES

BACKGROUND OF THE INVENTION

The present invention is generally directed to toner processes, and more specifically, to coalescence processes for the preparation of toner compositions. In embodiments, the present invention is directed to the economical preparation of toners without the utilization of the known pulverization and/or classification methods, and wherein toners with an average volume diameter of from about 1 to about 25, and preferably from 3 to about 14 microns, and narrow GSD characteristics can be obtained. The resulting toners can be selected for known electrophotographic imaging and printing processes, including color processes, and lighography. In embodiments, the present invention is directed to in situ processes for recycling toner fines, that is, for example, the use of classified toner materials obtained from conventional process, like melt blending, wherein the average particle volume diameter of the toner particles is from about 0.01 and preferably to about 7 microns. In one embodiment, the present invention is directed to in situ processes for preparing toners by first dispersing toner fines in an aqueous solution containing an ionic surfactant and nonionic surfactant by utilizing, for example, a high shearing device, such as a Branson 750 Ultrasonifyer or Brinkman Polytron, adding thereto a counterionic surfactant with a polarity opposite to that of the ionic aqueous surfactant resulting in a flocculation or heterocoagulation, and shearing the mixture thereafter for an effective period of time of, for example, from about 1 minute to about 10 minutes, followed by stirring for an induction period of from, for example, about 5 minutes to about 3 days and heating the mixture above the glass transition temperature, such as from about 10° C. to about 50° C. above the glass transition temperature of the resin, to cause coalescence of the toner fine particles and provide toner particles of, for example, from about 7 microns to about 21 microns in average volume diameter. In another embodiment thereof, the present invention is directed to an in situ process comprised of first dispersing fine toner particles of average volume diameter of from about 1 micron to about 5 microns, and comprised of, for example, a pigment such as carbon black, HELIOGEN BLUE TM or HOSTAPERM PINK TM of from about 2 to about 10 percent by weight of toner, a resin such as styrene butadiene or styrene methacrylate of from about 70 to about 97 percent by weight of the toner and optional charge control agent of from about 0.1 to about 3 percent by weight of the toner in an aqueous mixture containing a cationic surfactant, such as MIRAPOL TM or SANIZOL B-50 TM, and nonionic surfactant such as IGEPAL 897 TM, utilizing a high shearing device, such as Branson 750 ultrasonicator or a Brinkman Polytron, or microfluidizer or sonicator, thereafter adding an anionic surfactant such as sodium dodecyl sulfate or NEOGEN R TM, thereby resulting in a flocculation or heterocoagulation of the fine toner particles, and which on further shearing of from about 1 minute to about 120 minutes followed by mechanical stirring of from about 1 minute to about 3 days results in the redispersion of the fine toner particles; and thereafter heating to provide for fine toner particle fusion or coalescence; followed by washing with, for example, hot water to remove surfactant, and drying whereby toner particles comprised of resin and pigment with various particle size diameters can be obtained, such as from about 5 to about 21 microns in average volume particle diameter. The aforementioned toners are especially useful for the development of colored images with excellent line and solid resolution, and wherein substantially no background deposits are present. While not being desired to be limited by theory, it is believed that the flocculation or heterocoagulation is formed by the neutralization of the cationic surfactant absorbed on the toner particles, with the anionic surfactant added during shearing step. The high shearing stage disperses the formed large flocculants to a dispersed mixture of fine toner particles. Thereafter, heating is applied to fuse the fine toner particles or coalesce the fine particles to toner composites. Furthermore, in other embodiments the ionic surfactants addition can be changed, such that the fine toner particles are first dispersed in an aqueous solution containing the anionic surfactant, and the cationic surfactant is added thereafter, followed by shearing, stirring and heating to provide toner particles by fusion or coalescence of the fine toner particle to toner size particles of from about 7 to about 21 microns in average volume diameter as measured by the Coulter Counter. In embodiments, the toner composite morphology can be controlled such that a potato shape is attained by heating the statically bounded aggregate particle of from about 10° to about 20° C. above the glass transition temperature of the resin, which is generally from about 50° to about 65° C., or alternatively can be controlled such that a spherical shape is attained by heating the statically bounded aggregate particles to from about 20° to about 40° C. above the glass transition temperature of the resin.

Numerous processes are known for the preparation of toners, such as, for example, conventional processes wherein a resin is melt kneaded or extruded with a pigment, micronized and pulverized to provide toner particles with an average volume particle diameter of from about 7 microns to about 20 microns and with broad geometric size distribution of from about 1.4 to about 1.7. In such processes, it is usually necessary to subject the aforementioned toners to a classification procedure such that the geometric size distribution of from about 1.2 to about 1.4 are attained. However, in the aforementioned conventional process, low toner yields after classification may be obtained. Generally, during the preparation of toners with average particle size diameters of from about 11 microns to about 15 microns, toner yields range from about 70 percent to about 85 percent after classification. The classified portions, which are from about 15 to about 30 percent by weight of the toner, are of average volume diameter of from about 5 to about 9 microns as measured by a Coulter Counter. This classified portion is usually recycled in the extrusion or melt kneading step, or disposed in acceptable land filled sites. Moreover, during the preparation of smaller sized toners with particle sizes of from about 7 microns to about 11 microns, lower toner yields are obtained after classification, such as from about 50 percent to about 60 percent after classification, and the classified portion is from about 40 to about 50 percent by weight of toner of average volume diameter of from about 1 to about 5 microns as measured by the Coulter Counter. This classified portion is usually recycled in the melt kneaded or extrusion steps. With the processes of the present invention, in embodiments the classified portion is referred to as fine toner particles, and of from, for example, about 2 microns to about 5 microns in average diameter can be recycled in a more economical manner without resorting to conventional process such as melt kneading or extruding, micronizing and pulverizing. With the process of this invention, the toner fines can be recycled to provide toners of from about 7 to about 21 microns as determined by the Coulter Counter and with geometric size distributions, such as from about 1.20 to about 1.4, and preferably from about 1.20 to about 1.35. High toner yields are attained, such as from about 90 percent to about 98 percent, in embodiments of the present invention.

There is illustrated in U.S. Pat. No. 4,996,127 a toner of associated particles of secondary particles comprising primary particles of a polymer having acidic or basic polar groups and a coloring agent. The polymers selected for the toners of this '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer such as acrylic acid in the emulsion resin is necessary, and toner preparation is not obtained without the use, for example, of acrylic acid polar group, see Comparative Example I. The process of the present invention need not utilize polymers with polar acid groups, and toners can be prepared with resins such as poly(styrene butadiene) or PLIOTONE TM without containing polar acid groups. Additionally, the toner of the '127 patent does not utilize, it is believed, counterionic surfactant and flocculation process. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed, for example, to the use of coagulants, such as inorganic magnesium sulfate, which are not easily removed from the toner product. Furthermore, the '488 patent does not disclose the use of counterionic flocculation. Similarly, the aforementioned disadvantages are noted in other prior art, such as U.S. Pat. No. 4,797,339, wherein there is disclosed a process for the preparation of toners by resin emulsion polymerization, which similar to the '127 patent utilizes polar resins of opposite charges, and wherein flocculation as in the present invention is not disclosed; and U.S. Pat. No. 4,558,108, wherein there is disclosed a process for the preparation of a copolymer of styrene and butadiene by specific suspension polymerization.

In copending application U.S. Ser. No. 921,165, the disclosure of which is totally incorporated herein by reference, there is disclosed a process for the preparation of toners comprised of dispersing a polymer solution comprised of an organic solvent, and a polyester homogenizing and heating the mixture to remove the solvent and permit formation of the toner composites. Additionally, there is disclosed in U.S. Pat. No. 5,278,020, the disclosure of which is totally incorporated herein by reference, a process for the preparation of in situ toners comprising a halogenization procedure which chlorinates the outer surface of the toner which results in enhanced blocking properties. More spefifically, this patent application discloses an aggregation process wherein a pigment mixture containing an ionic surfactant is added to a resin mixture containing a polymer resin particles of less than 1 micron nonionic and counterionic surfactant, and thereby causing a flocculation which is dispersed to statically bound aggregates of about 0.5 to about 5 microns in volume diameter as measured by the Coulter Counter, and thereafter heating to form toner composites of from about 3 to about 7 microns in volume diameter and narrow geometric size distribution of from about 1.2 to about 1.4, as measured by the Coulter Counter, and which apparently exhibit low fixing temperature of from about 125° to about 150° C., low paper curling, and image to paper gloss matching.

SUMMARY OF THE INVENTION

It is an object of the present invention to provide toner processes with many of the advantages illustrated herein.

In another object of the present invention there are provided simple and economical processes for the direct preparation of black and colored toner compositions from toner fines, and wherein toner fines are recycled rather than discarded.

Another object of the present invention resides in a process for the preparation of toners with an average particle diameter of from between about 1 to about 50 microns, and preferably from about 3 to about 21 microns, and with narrow GSD such as from about 1.1 to about 1.4.

In yet another object of the present invention there are provided toner in situ processes by dispersing fine toner particles in an aqueous solution containing surfactant, adding thereafter a counterionic surfactant thereby causing flocculation of said particles, homogenizing the flocculent, and subsequently heating the mixture to aggregate or coalesce said fine toner particles to larger toner particles.

These and other objects of the present invention are accomplished in embodiments by the provision of toners and processes thereof. In embodiments of the present invention, there are provided processes for the economical direct preparation of toners by a coalescence process.

In embodiments, the present invention is directed to processes for the preparation of toners, which comprise generating an aqueous dispersion in a surfactant of toner fines obtained, for example, from the manufacture of toner, which fines have an average volume diameter of from about 3 to about 9 microns, adding thereto a surfactant with an opposite polarity than said dispersion causing a flocculation or heterocoagulation, followed by shearing the resultant flocculant until such time as a redispersion of fine toner particles is attained, followed by mechanically stirring the mixture for a prolonged induction period of from about 1 hour to about 3 days, which is believed to cause complete neutralization of the ionic surfactant, and heating to provide for the coalescence of the toner fines to larger toner particles with, for example, average volume diameters of from about 7 to about 20, and preferably from about 7 to about 15 microns as determined by Coulter Counter measurements. In embodiments of the present invention, an aqueous dispersion of about 25 to about 35 percent by solids is prepared by (i) dispersing toner fines comprised of a resin, such as styrene-butadiene of from about 90 to about 92 percent by weight of toner, a pigment such as HELIOGEN GREEN TM of from about 7 percent by weight of toner and charge control agent, such as diethyl or dimethyl distearyl ammonium methyl sulfate of from about 1 percent by toner weight, in an aqueous solution containing a cationic surfactant such as an alkyl benzyl dimethyl ammonium chloride of from about 1 to about 3 percent by weight of water, a nonionic surfactant such as polyoxyethylene nonylphenyl ether of from about 1 to about 3 percent by weight of water and utilizing a high shearing device such as a Branson 750 ultrasonicator or Polytron at a rotor speed of from about 2,000 to about 10,000 revolutions per minute for a duration of from about 5 to about 120 minutes; (ii) subsequently adding to the mixture an anionic surfactant such as sodium dodecyl benzene sulfonate of from about 1 to about 10 percent by weight of water thereby causing a flocculation of fine toner particles; (iii) shearing the flocculated mixture utilizing a high shearing device, such as a Polytron, at a rotor speed of from about 200 to about 6,000 revolutions per minute for a duration of from about 5 to about 120 minutes; (iv) stirring the resultant dispersed mixture by utilizing a mechanical stirrer operating at a speed of from about 100 to about 500 revolutions per minute for a duration of from about 1 hour to about 3 days; (v) heating the mixture at about 70 to about 80° C. for a duration of from about 60 to about 720 minutes; and (vi) followed by washing the mixture with hot water about 4 to 6 times, and separating the toner product particles by filtration and drying utilizing an Aeromatic fluid bed dryer to yield toner particles of from about 90 to about 99 percent yield by toner weight and of average volume diameter of from about 7 to about 19 microns and geometric size distribution of about 1.2 to about 1.4 as measured by the Coulter Counter.

In embodiments, the present invention is directed to a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles; and wherein the nonionic surfactant is selected from the group consisting of polyvinyl alcohol, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene nonylphenyl ether, polyoxyethylene oleyl ether, polyoxyethylene sorbitan monolaurate, polyoxyethylene stearyl ether, and dialkylphenoxy poly(ethyleneoxy)ethanol; the anionic surfactant is selected from the group consisting of ammonium lauryl sulfate, sodium dodecyl benzene sulfonate, dodecyl benzene sulfonic acid, sodium alkyl naphthalene sulfonate, sodium dialkyl sulfosuccinate, sodium alkyl diphenyl ether disulfonate, potassium salt of alkylphosphate, sodium polyoxyethylene lauryl ether sulfate, sodium polyoxyethylene alkyl ether sulfate, sodium polyoxyethylene alkyl ether sulfate, triethanolamine polyoxyethylene alkylether sulfate, sodium naphthalene sulfate, sodium naphthalene sulfonate formaldehyde condensate; and the cationic surfactant is selected from the group consisting of lauryl trimethyl ammonium chloride, stearyl trimethyl ammonium chloride, cetyl trimethyl ammonium chloride, stearyl trimethyl ammonium chloride, distearyl dimethyl ammonium chloride, alkylbenzyl dimethyl ammonium chloride, lauryl betaine, stearyl betaine, lauryl imadazolium betaine, and lauryl dimethyl amine oxide.

Illustrative examples of toner fines are comprised of polymer resins and pigments. Polymer examples include polyesters such as polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(propoxylated bisphenol-fumarate), poly(propoxylated bisphenol-succinate), poly(propoxylated bisphenol-adipate), poly(propoxylated bisphenol-glutarate), SPAR TM (Dixie Chemicals), BECKOSOL TM (Reichhold Chemical Inc), ARAKOTE TM (Ciba-Geigy Corporation), HETRON TM (Ashland Chemical), PARAPLEX TM (Rohm & Hass), POLYLITE TM (Reichhold Chemical Inc), PLASTHALL TM (Rohm & Hass), CYGAL TM (American Cyanamide), ARMCO TM (Armco Composites), ARPOL TM (Ashland Chemical), CELANEX TM (Celanese Eng), RYNITE TM (DuPont), STYPOL TM (Freeman Chemical Corporation) mixtures thereof and the like; polycarbonates such as LEXAN TM (G.E. Plastics), BAYLON TM (Bayer), MAKROLON TM (Mobay), MERLON TM (Mobay), PANLITE TM (Teijin Chemical), mixtures thereof and like; polyurethanes such as PELLETHANE TM (Dow), ESTANE TM (Goodyear), CYTOR TM (American Cyanamide), TEXIN TM (Mobay), VIBRATHANE TM (Uniroyal Chemical), CONATHANE TM (Conap Company), polystyrene, polyacrylate, polymethacrylate, polystyrene-butadiene, polystyrene-methacrylate, polystyrene-acrylate, mixtures thereof and, the like. Generally, the toner resin can be comprised of styrene methacrylates, styrene acrylates, styrene butadienes, polyesters, including crosslinked polyesters, mixtures thereof, and the like; crosslinked polyesters that may be selected include those of copending application U.S. Ser. No. 814,641 (D/91117).

Various known pigments present in the toner in an effective amount of, for example, from about 1 to about 25 percent by weight of the toner, and preferably in an amount of from about 1 to about 15 weight percent, that can be selected include carbon black, like REGAL 330 TM; magnetites, such as Mobay magnetites MO8029 TM; MO8060 TM; Columbian magnetites; MAPICO BLACKS ® and surface treated magnetites; Pfizer magnetites, CB4799 TM, CB5300 TM, CB5600 TM, MCX6369 TM; Bayer magnetites, BAYFERROX 8600 TM, 8610 TM; Northern Pigments magnetites, NP-604 TM, NP-608 TM; Magnox magnetites TMB-100 TM, or TMB-104 TM; and other equivalent black pigments. As colored pigments other than black, there can be selected known cyan, magenta, yellow, red, green, brown, blue or mixtures thereof. Specific examples of pigments include HELIOGEN BLUE L6900 TM, D6840 TM, D7080 TM, D7020 TM, PYLAM OIL BLUE TM, PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E. D. TOLUIDINE RED TM and BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permament Yellow FGL. Colored magnetites, such as mixtures of MAPICO BLACK TM, and cyan components may also be selected as pigments with the process of the present invention. The pigments selected are present in various effective amounts, such as from about 1 weight percent to about 65 weight percent of the toner.

The toner may also include known charge additives such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, and the like. Also, known negative charge additives, such as aluminum complexes and TRH, can be selected.

Toner fines containing the above and other components can be obtained from classified portions generated, for example, during the manufacture of conventional toners such as the Xerox Corporation 1075 toner, Xerox Corporation 1090 toner, Xerox Corporation 3100 toner, Xerox Corporation 9200 toner, Xerox Corporation 5090 toner, Xerox Corporation 5060 toner, polyester toner, and from the manufacturing of other known toners.

Surfactants selected in effective amounts of, for example, 0.1 to about 25 weight percent in embodiments include, for example, nonionic surfactants such as polyvinyl alcohol, polyacrylic acid, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octyphenyl ether, polyoxyethylene oleyl ether, polyoxyethylene sorbitan monolaurate, polyoxyethylene stearyl ether, polyoxyethylene nonylphenyl ether, available from GAF as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTARAX 890 TM and ANTARAX 897 TM, available from Rhone-Poulenac, EMULGEN TM, NEOGEN TM available from Kao Corporation, dialkylphenoxy poly(ethyleneoxy)ethanol; ionic and cationic or counterionic surfactants such as sodium dodecyl sulfate, sodium dodecyl-benzene sulfate, sodium dodecylnaphthalene sulfate, dialkyl benzene dimethyl ammonium chloride, lauryl trimethyl ammonium chloride, stearyl trimethyl ammonium chloride, cetyl trimethyl ammonium chloride, stearyl trimethyl ammonium chloride, distearyl dimethyl ammonium chloride, lauryl betaine, stearyl betaine, lauryl imidazolinium betaine, lauryl dimethyl amine oxide, QUARTAMIN TM, SANIZOL TM, AMPHITOL TM, MIRAPOL TM, SANIZOL TM, mixtures thereof, and the like. The surfactant is utilized in various effective amounts, such as for example preferably from about 0.1 percent to about 5 percent by weight of water.

Surface additives that can be added to the toner compositions include, for example, metal salts, metal salts of fatty acids, colloidal silicas, mixtures thereof, and the like, which additives are usually present in an amount of from about 0.1 to about 1 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference.

Percentage amounts of components are based on the total toner components unless otherwise indicated.

The following Examples are being submitted to further define various species of the present invention. These Examples are intended to be illustrative only and are not intended to limit the scope of the present invention. Also, parts and percentages are by weight unless otherwise indicated. Comparative Examples are also provided.

EXAMPLE I

An 8.1 micron green toner comprised of a styrene/butylacrylate resin and HELIOGEN GREEN TM pigment was prepared as follows.

Two hundred (200) grams of green toner fines comprised of 92 percent by weight of the toner of poly(styrene-butadiene) resin, 7 percent by weight of HELIOGEN GREEN TM pigment (available from Hoechst) and 1 percent by weight of dimethyl distearyl ammonium methyl sulfate was dispersed in water (2 liters) containing 5.8 grams of the anionic surfactant dodecyl benzene sulfonic acid sodium salt (available from Kao as NEOGEN SC TM) and 5.0 grams of the nonionic surfactant polyoxyethylene nonyl phenol ether, available from Rhone-Poulenac as ANTAROX CA 897 TM, using ultrasonication for 3 minutes. To this negatively charged dispersion was then added 6.7 grams of the cationic or counterionic surfactant dialkyl dimethyl benzene ammonium chloride, available from Kao as SANIZOL B-50 TM. Upon completion of the cationic addition, a flocculation of toner fine particles was observed. The flocculated mixture was then homogenized for 5 minutes at 10,000 RPM, followed by stirring at ambient, about 25° C., temperature for about 20 hours. The mixture was then heated to 80° C. for a duration of two hours, followed by filtration, washing about 6 times with about 300 milliliters of warm water (40° to 75° C.), and drying the wet filtered cake at 40° C. for a duration of 3 hours utilizing the Aeromatic Fluid bed dryer to yield 192 grams of toner (96 percent yield). The resulting green toner particles were determined to be of 8.1 microns in average volume diameter as measured by the Coulter Counter and had a geometric size distribution of 1.34.

EXAMPLE II

An 11.5 micron green toner comprised of a styrene/-butylacrylate resin and HELIOGEN GREEN TM pigment was prepared as follows.

Two hundred (200) grams of green toner fines comprised of 92 percent by weight of toner of poly(styrene-butadiene) resin, 7 percent by weight of HELIOGEN GREEN TM pigment (available from Hoechst) and 1 percent by weight of dimethyl distearyl ammonium methyl sulfate was dispersed in water (2 liters) containing 5.8 grams of the anionic surfactant dodecyl benzene sulfonic acid sodium salt, available from Kao as NEOGEN SC TM, and 5.0 grams of the nonionic surfactant polyoxyethylene nonyl phenol ether, available from Rhone-Poulenac as ANTAROX CA 897 TM, using ultrasonication for 3 minutes. To this negatively charged dispersion was then added 6.7 grams of the cationic surfactant dialkyl dimethyl benzene ammonium chloride, available from Kao as SANIZOL B-50 TM. Upon completion of the cationic addition, a flocculation of toner fine particles was observed. The flocculated mixture was then homogenized for 5 minutes at 10,000 RPM, followed by stirring at ambient temperature for about 18 hours. The mixture was then heated to 80° C. for a duration of four hours, followed by filtration, washing about 6 times with about 300 milliliters of warm water (40° to 75° C.), and drying the wet filtered cake at 40° C. for a duration of 3 hours utilizing an Aeromatic Fluid bed dryer to yield 193 grams of toner (96.5 percent yield). The green toner particles were determined to be of 11.5 microns in average volume diameter as measured by the Coulter Counter and had a geometric size distribution of 1.4.

EXAMPLE III

A 9 micron green toner comprised of a styrene/-butylacrylate resin and HELIOGEN GREEN TM pigment was prepared as follows.

Two hundred (200) grams of green toner fines comprised of 92 percent by weight of toner of poly(styrene-butadiene) resin, 7 percent by weight of HELIOGEN GREEN TM pigment (available from Hoechst) and 1 percent by weight of dimethyl distearyl ammonium methyl sulfate was dispersed in water (2 liters) containing 5.8 grams of the anionic surfactant dodecyl benzene sulfonic acid sodium salt (available from Kao as NEOGEN SC TM) and 5.0 grams of the nonionic surfactant polyoxyethylene nonyl phenol ether (available from Rhone-Poulenac as ANTAROX CA 897 TM) using ultrasonication for 3 minutes. To this negatively charged dispersion was than added 6.7 grams of the cationic surfactant dialkyl dimethyl benzene ammonium chloride (available from Kao as SANIZOL B-50 TM). Upon completion of the cationic addition, a flocculation of toner fine particles was observed. The flocculated mixture was then homogenized for 5 minutes at 10,000 RPM, followed by stirring at ambient temperature for three days. The mixture was then heated to 80° C. for a duration of 4 hours, followed by filtration, and washing about 6 times with about 300 milliliters of warm water (40° to 75° C.), and drying the wet filtered cake at 40° C. for a duration of 3 hours utilizing an Aeromatic Fluid bed dryer to yield 194 grams of toner (97 percent yield). The green toner particles were measured to be of 9 microns in average volume diameter as determined by a Coulter Counter and had a geometric size distribution of 1.33.

EXAMPLE IV

An 18 micron magenta toner comprised of a polyester resin and HOSTAPERM PINK TM pigment was prepared as follows.

Two hundred and forty (240) grams of magenta toner fines displaying an average volume diameter of 3.4 microns and GSD of 1.31, and comprised of 92 percent by weight of polyester resin derived cyclohexanediol, bisphenol A and terephthalic acid, and 7 percent by weight of HOSTAPERM PINK TM pigment (available from Hoechst) was dispersed in water (1.4 liters) containing 5.5 grams of the anionic surfactant dodecyl benzene sulfonic acid sodium salt (available from Kao as NEOGEN SC TM) and 5.7 grams of the nonionic surfactant polyoxyethylene nonyl phenol ether (available from Rhone-Poulenac as ANTAROX CA 897 TM) using ultrasonication for 5 minutes. To this negatively charged dispersion was than added 10 grams of the cationic surfactant dialkyl dimethyl benzene ammonium chloride (available from Kao as SANIZOL B-50 TM). Upon completion of the cationic addition, a flocculation of toner fine particles resulted. The flocculated mixture was then homogenized for 2 minutes at 10,000 RPM, followed by stirring at 40° C. overnight, about 18 hours. The mixture was then heated to 80° C. for a duration of 1 hour, followed by filtration, and washing about 6 times with about 300 milliliters of warm water (40° to 75° C.), and drying the wet filtered cake at 40° C. for a duration of 3 hours utilizing the Aeromatic Fluid bed dryer to yield 230 grams of toner (96 percent yield). The green toner particles were 18 microns in average volume diameter as measured by the Coulter Counter and had a geometric size distribution of 1.29.

EXAMPLE V

A 9 micron magenta toner comprised of a polyester resin and HOSTAPERM PINK TM pigment was prepared as follows.

Two hundred and forty (240) grams of magenta toner fines displaying an average volume diameter of 3.4 microns and GSD of 1.31, and comprised of 92 percent by weight of polyester resin derived cyclohexanediol, bisphenol A and terephthalic acid, and 7 percent by weight of HOSTAPERM PINK TM pigment (available from Hoechst) was dispersed in water (1.4 liters) containing 5.5 grams of the anionic surfactant dodecyl benzene sulfonic acid sodium salt (available from Kao as NEOGEN SC TM) and 5.7 grams of the nonionic surfactant polyoxyethylene nonyl phenol ether (available from Rhone-Poulenac as ANTAROX CA 897 TM) using ultrasonication for 5 minutes. To this negatively charged dispersion was than added 10 grams of the cationic surfactant dialkyl dimethyl benzene ammonium chloride (available from Kao as SANIZOL B-50 TM). Upon completion of the cationic addition, a flocculation of toner fine particles was observed. The flocculated mixture was then homogenized for 2 minutes at 10,000 RPM, followed by stirring at ambient temperature overnight, about 20 hours. The mixture was then heated to 75° C. for a duration of 2 hours, followed by filtration, and washing about 6 times with about 300 milliliters of warm water (40° to 75° C.), and drying the wet filtered cake at 40° C. for a duration of 3 hours utilizing the Aeromatic Fluid bed dryer to yield 229 grams of toner (95.4 percent yield). The magenta toner particles were 9 microns in average volume diameter as measured by the Coulter Counter and had a geometric size distribution of 1.28.

EXAMPLE VI

A 7.2 micron magenta toner comprised of a polyester resin and HOSTAPERM PINK TM pigment was prepared as follows.

Two hundred and forty (240) grams of magenta toner fines displaying an average volume diameter of 3.4 microns and GSD of 1.31, and comprised of 92 percent by weight of polyester resin derived cyclohexanediol, bisphenol A and terephthalic acid, and 7 percent by weight of HOSTAPERM PINK TM pigment (available from Hoechst) was dispersed in water (1.4 liters) containing 5.5 grams of the anionic surfactant dodecyl benzene sulfonic acid sodium salt (available from Kao as NEOGEN SC TM) and 5.7 grams of the nonionic surfactant polyoxyethylene nonyl phenol ether (available from Rhone-Poulenac as ANTAROX CA 897 TM) using ultrasonication for 5 minutes. To this negatively charged dispersion was than added 10 grams of the cationic surfactant dialkyl dimethyl benzene ammonium chloride (available from Kao as SANIZOL B-50 TM). Upon completion of the cationic addition, a flocculation of toner fine particles was observed. The flocculated mixture was then homogenized for 2 minutes at 10,000 RPM, followed by stirring at ambient temperature overnight, about 20 hours. The mixture was then heated to 70° C. for a duration of 2 hours, followed by filtration, washing about 6 times with about 300 milliliters of warm water (40° to 75° C.), and drying the wet filtered cake at 40° C. for a duration of 3 hours utilizing the Aeromatic Fluid bed dryer to yield 232 grams of toner (96.6 percent yield). The magenta toner particles were determined to be of 7.2 microns in average volume diameter as measured by the Coulter Counter and had a geometric size distribution of 1.27.

EXAMPLE VII

An 11 micron black toner comprised of a polyester resin and REGAL 330® pigment was prepared as follows.

Two hundred and forty (240) grams of black toner fines displaying an average volume diameter of 5.1 microns and GSD of 1.38, and comprised of 92 percent by weight of polyester resin (SPAR II TM, available from Ashland Chemical), derived propoxylated bisphenol A and fumaric acid, 2 percent by weight of cetyl pyridinium chloride charge additive and 6 percent by weight of REGAL 330® pigment was dispersed in water (1.4 liters) containing 5.5 grams of the anionic surfactant dodecyl benzene sulfonic acid sodium salt (available from Kao as NEOGEN SC TM) and 5.7 grams of the nonionic surfactant polyoxyethylene nonyl phenol ether (available from Rhone-Poulenac as ANTAROX CA 897) using ultrasonication for 5 minutes. To this negatively charged dispersion was than added 10 grams of the cationic surfactant dialkyl dimethyl benzene ammonium chloride (available from Kao as SANIZOL B-50 TM). Upon completion of the cationic addition, a flocculation of toner fine particles resulted. The flocculated mixture was then homogenized for 2 minutes at 10,000 RPM, followed by stirring at ambient temperature overnight. The mixture was then heated to 80° C. for a duration of 3 hours, followed by filtration, washing about 6 times with about 300 milliliters of warm water (40° to 75° C.), and drying the wet filtered cake at 40° C. for a duration of 3 hours utilizing the Aeromatic Fluid bed drier to yield 230 grams of toner (95 percent yield). The black toner particles were determined to be 11 microns in average volume diameter as measured by the Coulter Counter and had a geometric size distribution of 1.31.

CONTROL EXAMPLE VIII

An 11 micron magenta toner comprised of a polyester resin and HOSTAPERM PINK TM pigment was prepared by a known conventional process as follows.

A mixture of 1,266 grams of a polyester derived from cyclohexanediol, propoxylated bisphenol A and terephthalic acid, and 95.3 grams of HOSTAPERM PINK TM pigment was mixed and ground in a Fitzmill Model J equipped with an 850 micrometer screen. After grinding, the mixture was dry blended first on a paint shaker and then on a roll mill. A small DAVO TM counter-rotating twin screw extruder was then used to melt mix the aforementioned mixture. A K-Tron twin screw volumetric feeder was employed in feeding the mixture to the extruder which had a barrel temperature of 130° C. (flat temperature profile), and a screw rotational speed of 60 rpm with a feed rate of 10 grams per minute. The extruded strands were broken down into coarse particles by passing them through a Model J Fitzmill twice, first with an 850 micrometer screen, and then with a 425 micrometer screen. The coarse particles thus produced were micronized using an 8 inch Sturtevant micronizer and classified in a Donaldson classifier. There was obtained after classification 57 percent yield by weight of toner of volume average diameter of 7.2 microns and geometric distribution of 1.36 as measured by the Coulter Counter. The remainder of the unwanted classified toner fines accounted for about 43 percent by weight of toner and was measured by the Coulter Counter to be of average volume diameter particle size of 4.7 microns with a geometric distribution of 1.41.

The resultant toner fines (500 grams) were subsequently ground in a Fitzmill Model J equipped with an 850 micrometer screen. After grinding, the mixture was dry blended first on a paint shaker and then on a roll mill. A small DAVO TM counter-rotating twin screw extruder was then used to melt mix the aforementioned mixture. A K-Tron twin screw volumetric feeder was employed in feeding the mixture to the extruder which had a barrel temperature of 130° C. (flat temperature profile), and a screw rotational speed of 60 rpm with a feed rate of 10 grams per minute. The extruder strands were broken down into coarse particles by passing them through a Model J Fitzmill twice, first with an 850 micrometer screen, and then with a 425 micrometer screen. The coarse particles thus produced were micronized using an 8 inch Sturtevent micronizer and classified in a Donaldson classifier. There was obtained after classification 53 percent yield by weight of toner of volume average diameter of 7.6 microns and geometric distribution of 1.35 as measured by the Coulter Counter. The remainder of the unwanted classified toner fines accounted for about 46 percent by weight of toner and was measured by the Coulter Counter to be of average volume diameter particle size of 4.9 microns with a geometric distribution of 1.40. Recycling the fines by conventional processes, as described above, results in low toner yields of about 53 percent by weight.

EXAMPLE IX

A 7.5 micron magenta toner comprised of a polyester resin and HOSTAPERM PINK TM pigment utilizing the fine toner particles of Control or Comparative Example VIII was prepared as follows.

Two hundred and forty (240) grams of magenta toner fines of Comparative Example VIII, displaying an average volume diameter of 4.7 microns and GSD of 1.41, and comprised of 93 percent by weight of polyester resin derived cyclohexanediol, bisphenol A and terephthalic acid, and 7 percent by weight of HOSTAPERM PINK TM pigment (available from Hoechst) were dispersed in water (1.4 liters) containing 5.5 grams of the anionic surfactant dodecyl benzene sulfonic acid sodium salt (available from Kao as NEOGEN SC TM) and 5.7 grams of the nonionic surfactant polyoxyethylene nonyl phenol ether (available from Rhone-Poulenac as ANTAROX CA 897 TM) using ultrasonication for 5 minutes. To this negatively charged dispersion were then added 10 grams of the cationic surfactant dialkyl dimethyl benzene ammonium chloride (available from Kao as SANIZOL B-50 TM). Upon completion of the cationic addition, a flocculation of toner fine particles was observed. The flocculated mixture was then homogenized for 2 minutes at 10,000 RPM, followed by stirring at ambient temperature overnight. The mixture was then heated to 70° C. for a duration of 2 hours, followed by filtration, washing for about 6 times with about 300 milliliters of warm water (40° to 75° C.), and drying the wet filtered cake at 40° C. for a duration of 3 hours utilizing the Aeromatic Fluid bed dryer to yield 232 grams of toner (96.6 percent yield). The resulting magenta toner particles were determined to be of 7.5 microns in average volume diameter as measured by the Coulter Counter and had a geometric size distribution of 1.29. The fine toner particles of Comparative Example VIII were recycled to a high yield of about 97 percent by weight of toner with the process of the present invention, as compared to 47 percent by weight of toner when the same particle fines were recycled as in Example VIII by conventional process.

COMPARATIVE EXAMPLE X

A 12.5 micron green toner comprised of a polystyrene-butadiene resin, HELIOGEN GREEN TM, and dimethyl distearyl ammonium methyl sulfate was prepared by known conventional processes as follows.

A mixture of 1,252 grams of poly(styrene-butadiene) available from Goodyear as PLIOTONE TM, 95.3 grams of HELIOGEN GREEN TM pigment available from BASF, and 13.62 grams of dimethyl distearyl ammonium methyl sulfate was mixed and ground in a Fitzmill Model J equipped with an 850 micrometer screen. After grinding, the mixture was dry blended first on a paint shaker and then on a roll mill. A small DAVO TM counter-rotating twin screw extruder was then used to melt mix the aforementioned mixture. A K-Tron twin screw volumetric feeder was employed in feeding the mixture to the extruder which had a barrel temperature of 150° C. (flat temperature profile), and a screw rotational speed of 60 rpm with a feed rate of 10 grams per minute. The extruded strands were broken down into coarse particles by passing them through a Model J Fitzmill twice, first with an 850 micrometer screen, and then with a 425 micrometer screen. The coarse particles thus produced were micronized using an 8 inch Sturtevant micronizer and classified in a Donaldson classifier. There was obtained after classification 83 percent yield by weight of toner of volume average diameter of 12.5 microns and geometric distribution of 1.36 as measured by the Coulter Counter. The remainder of the unwanted classified toner fines accounted for about 17 percent by weight of toner and was measured by the Coulter Counter to be of average volume diameter particle size of 6.5 microns with a geometric distribution of 1.39.

The aforementioned resultant toner fines (231 grams) are usually disposed of in landfill sites.

EXAMPLE XI

A 12 micron green toner comprised of a styrene/-butylacrylate resin and HELIOGEN GREEN TM pigment was prepared as follows.

Two hundred (200) grams of green toner fines of Comparative Example X, comprised of 92 percent by weight of toner of poly(styrene-butadiene) resin (91/9), 7 percent by weight of HELIOGEN GREEN TM pigment (available from Hoechst) and 1 percent by weight of dimethyl stearyl ammonium methyl sulfate were dispersed in water (2 liters) containing 5.8 grams of the anionic surfactant dodecyl benzene sulfonic acid sodium salt (available from Kao as NEOGEN SC TM) and 5.0 grams of the nonionic surfactant polyoxyethylene nonyl phenol ether, available from Rhone-Poulenac as ANTAROX CA 897 TM, using ultrasonication for 3 minutes. To this negatively charged dispersion were then added 6.7 grams of the cationic surfactant dialkyl dimethyl benzene ammonium chloride, available from KAO as SANIZOL TM B-50. Upon completion of the cationic addition, a flocculation of toner fine particles was observed. The flocculated mixture was then homogenized for 5 minutes at 10,000 RPM, followed by stirring at ambient, about 25° C., temperature for about 18 hours. The mixture was then heated to 75° C. for a duration of 4 hours, followed by filtration, and washing the filtrate about 6 times with about 300 milliliters of warm water (40° to 75° C.), and drying the wet filtered cake at 40° C. for a duration of 3 hours utilizing the Aeromatic Fluid bed dryer to yield 192 grams of toner (96 percent yield). The resulting green toner particles were determined to be of 12 microns in average volume diameter as measured by the Coulter Counter and had a geometric size distribution of 1.37. The fine toner particles of Comparative Example X were recycled by the process of this invention and high yields of about 96 percent were obtained, and the disposal of toner fine particles in landfill sites is thus minimized or preferably avoided.

Other modifications of the present invention may occur to those skilled in the art subsequent to a review of the present application, and these modifications, including equivalents thereof, are intended to be included within the scope of the present invention.

What is claimed is:

1. A process for the preparation of a toner composition which comprises dispersing toner fine particles having a volume average diameter of from about 1 to about 15 microns and comprising polymer resin and pigment in an aqueous solution containing ionic surfactant and nonionic surfactant to form a mixture, adding thereto a counterionic surfactant with a polarity opposite to that of said ionic surfactant, homogenizing and stirring said mixture, and heating to provide coalescence of said toner fine particles, and whereby said toner is formed.

2. A process in accordance with claim 1 wherein the ionic surfactant is anionic, and the counterionic surfactant is cationic.

3. A process in accordance with claim 2 wherein the cationic surfactant is selected from the group consisting of lauryl trimethyl ammonium chloride, stearyl trimethyl ammonium chloride, cetyl trimethyl ammonium chloride, stearyl trimethyl ammonium chloride, distearyl dimethyl ammonium chloride, alkylbenzyl dimethyl ammonium chloride, lauryl betaine, stearyl betaine, lauryl imadazolium betaine, and lauryl dimethyl amine oxide.

4. A process in accordance with claim 1 wherein the ionic surfactant is cationic, and the counterionic surfactant is anionic.

5. A process in accordance with claim 1 wherein the dispersing of toner fine particles in the aqueous solution containing ionic surfactant and nonionic surfactant is accomplished by a high shearing ultrasonic probe, or by a high shear homogenizer.

6. A process in accordance with claim 3 wherein high shearing homogenization is accomplished by said homogenizer at from about 2,000 revolutions per minute to about 10,000 revolutions per minute for a duration of from about 1 minute to about 120 minutes.

7. A process in accordance with claim 5 wherein high shearing is accomplished by said ultrasonic probe at from about 300 watts to about 900 watts of energy, at from about 5 to about 50 megahertz of amplitude, at a temperature of from about 25° C. to about 55° C. and for a duration of from about 1 minute to about 120 minutes at from about 2,000 revolutions per minute to about 10,000 revolutions per minute.

8. A process in accordance with claim 1 wherein homogenization of said mixture after the addition of the counterionic surfactant is accomplished with stirring at from about 2,000 revolutions per minute to about 10,000 revolutions per minute for a duration of from about 1 minute to about 360 minutes.

9. A process in accordance with claim 1 wherein coalescence is accomplished by heating at a temperature from about 10° to 40° C. above the glass transition of the toner resin fines, which is about 40° to about 65° C.

10. A process in accordance with claim 1 wherein the resultant coalesced toner particles are of volume average diameter of from about 5 to about 21 microns.

11. A process in accordance with claim 1 wherein the toner obtained has a GSD of 1.2 to 1.4.

12. A process in accordance with claim 1 wherein the toner fines contain a polymer of a styrene acrylate, a styrene methacrylate, a styrene butadiene, or a polyester.

13. A process in accordance with claim 1 wherein the toner fines contain as a pigment carbon black, magnetite, or mixtures thereof.

14. A process in accordance with claim 1 wherein the toner fines contain as a pigment cyan, magenta, yellow, or mixtures thereof.

15. A process in accordance with claim 1 wherein the nonionic surfactant is selected from the group consisting of polyvinyl alcohol, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene nonylphenyl ether, polyoxyethylene oleyl ether, polyoxyethylene sorbitan monolaurate, polyoxyethylene stearyl ether, and dialkylphenoxy poly(ethyleneoxy)ethanol.

16. A process in accordance with claim 1 wherein the anionic surfactant is selected from the group consisting of ammonium lauryl sulfate, sodium dodecyl benzene sulfonate, dodecyl benzene sulfonic acid, sodium alkyl naphthalene sulfonate, sodium dialkyl sulfosuccinate, sodium alkyl diphenyl ether disulfonate, potassium salt of alkylphosphate, sodium polyoxyethylene lauryl ether sulfate, sodium polyoxyethylene alkyl ether sulfate, sodium polyoxyethylene alkyl ether sulfate, triethanolamine polyoxyethylene alkylether sulfate, sodium naphthalene sulfate, and sodium naphthalene sulfonate formaldehyde condensate.

17. A process in accordance with claim 1 wherein there is added to the toner product obtained surface additives of metal salts, metal salts of fatty acids, silicas, metal oxides, or mixtures thereof.

18. A process in accordance with claim 1 wherein the pigment for the toner fines is carbon black, magnetite, or mixtures thereof; cyan, magenta, yellow, or mixtures thereof; and said toner contains a resin of polyacrylic acid, polypropylene oxide, polybutylene oxide, or poly(oxyethylene-nonyl phenyl) ether.

19. A process in accordance with claim 1 wherein the toner fines are obtained from toner discarded from toner manufacturing processes.

20. A process in accordance with claim 1 wherein the toner formed is of an average volume diameter of from about 10 to about 20 microns.

21. A process in accordance with claim 1 wherein the toner formed is of an average volume diameter of from about 11 to about 15 microns.

22. A process in accordance with claim 1 wherein stirring of said mixture is accomplished at from about 10 revolutions per minute to about 500 revolutions per minute for a duration of from about 1 hour to about 3 days.

23. A process in accordance with claim 1 wherein the nonionic surfactant functions to initially disperse the fine particles in the aqueous phase, and subsequently to prevent or minimize the coalesced particles from agglomerating; and wherein the counterionic surfactant, which is of an opposite polarity than said ionic surfactant, neutralizes the polar charge on the fine toner particle surface thereby causing flocculation or heterocoagulation.

24. A process in accordance with claim 1 wherein the nonionic surfactant is of a neutral polarity.

25. A process in accordance with claim 1 wherein heating is accomplished at from about 10° C. to about 50° C. above the glass transition temperature of the toner resin.

26. A process in accordance with claim 1 wherein heating is accomplished at a temperature of from about 25° to about 95° C.

27. A process in accordance with claim 1 wherein a mixture of toner fines is selected.

28. A process in accordance with claim 1 wherein said toner contains a styrene acrylate, a styrene methacrylate, or a polyester resin.

29. A process for utilizing discarded toner fine particles consisting essentially of dispersing said toner fine particles having a volume average diameter of from about 1 to about 15 microns and comprising polymer resin and pigment in an aqueous solution containing ionic surfactant and nonionic surfactant; adding thereto a counterionic surfactant with a polarity opposite that of said ionic surfactant to form a mixture; homogenizing and stirring said mixture, and heating to provide for coalescence of said toner fine particles; and whereby a toner is formed.

* * * * *